United States Patent [19]

O'Loughlin et al.

[11] Patent Number: 4,771,538

[45] Date of Patent: Sep. 20, 1988

[54] FLAG SHAPED ELECTRICAL CONNECTOR

[75] Inventors: Francis A. O'Loughlin, Scotch Plains; Jose M. Piriz, Hillside, both of N.J.

[73] Assignee: Thomas & Betts Corporation, Bridgewater, N.J.

[21] Appl. No.: 839,310

[22] Filed: Mar. 13, 1986

[51] Int. Cl.[4] ..... H01R 43/16

[52] U.S. Cl. ..... 29/874; 29/863

[58] Field of Search ..... 29/857, 861, 863, 874

[56] References Cited

U.S. PATENT DOCUMENTS

| | | | |
|---|---|---|---|
| 1,937,431 | 11/1933 | Mendel | 29/863 |
| 2,728,002 | 12/1955 | Turner . | |
| 3,493,916 | 2/1970 | Hansen | 339/17 |
| 3,500,295 | 3/1970 | Faber | 339/176 |
| 4,050,769 | 9/1977 | Ammon | 339/196 |
| 4,080,041 | 3/1978 | Hawkins, Jr. | 339/196 |
| 4,196,957 | 4/1980 | Benasutti | 339/176 |
| 4,531,807 | 7/1985 | Trigon | 339/223 |
| 4,552,430 | 11/1985 | Myers | 339/242 |
| 4,598,474 | 7/1986 | Lutz | 29/863 |
| 4,598,971 | 7/1986 | Goodman | 339/228 |

FOREIGN PATENT DOCUMENTS

| | | | |
|---|---|---|---|
| 1013047 | 6/1977 | Canada . | |
| 213469 | 2/1961 | Fed. Rep. of Germany | 29/861 |
| 1220001 | 6/1966 | Fed. Rep. of Germany . | |

OTHER PUBLICATIONS

T & B Method Grid Grounding Lug–2 Bolt Hole Flag Type, (10/15/79).

The T & B Distributor Serves and Saves—T & B Method Copper Lugs, (1964).

*Primary Examiner*—Timothy V. Eley

*Attorney, Agent, or Firm*—Robert M. Rodrick; Salvatore J. Abbruzzese

[57] ABSTRACT

A method is disclosed of making an electrical connector. A longitudinal extent of tubing is provided which is flattened along the central extent. The central extent is then bent to place the ends at an angular disposition. One end of the tubular extent is formed into a connection terminal for connection to an external electrical device and the other end forms a barrel connection for crimping to a bared end of an electrical cable.

17 Claims, 3 Drawing Sheets

FLAG SHAPED ELECTRICAL CONNECTOR

FIELD OF INVENTION

This invention relates generally to a method of making an electrical connector and more particularly to a method of making an electrical connector terminal from a hollow tube where the ends of the connector terminal are disposed at an angular orientation.

BACKGROUND OF THE INVENTION

Electrical terminals of the type described herein include a tubular end portion commonly referred to as a barrel, which may be placed over the stripped end of an electrical cable containing solid or stranded conductors therein. This barrel may be crimped or otherwise mechanically and electrically secured to the stripped end of the cable. The other end of the terminal typically includes terminal tongue which is of a wide variety of shapes and sizes for effecting different terminations.

Typically, these terminals are elongate members having the barrel at one end and the terminal end at the other. Thus, connectors of this type make a straight line connection between the electrical cable and the electrical device to which it is terminated.

However, the industry has seen a need to make connections to termination portions on an electrical device with the cable being introduced at some angle (typically 90°) to the electrical device. Quite often the cables themselves are bent in order to make such connection. However, it is apparent that bending the cable in this manner may cause the insulation around the cable to crack or break which could lead to problems due to insufficient insulation covering the cable.

One solution to this problem is to cast a right angle (or any other desired angle) connector for making such transition in the connector itself. However, an individually cast part must be formed for each specific application.

Right angle electrical contacts are widely used in electrical connector housings, for example, to make right angle transitions. Such contacts are shown in U.S. Pat. Nos. 4,050,769 issued Sept. 27, 1977 and 4,080,041 issued Mar. 4, 1978. Right angle contacts of this type may also be used individually as cable terminations as is shown in U.S. Pat. No. 4,552,430 issued Nov. 12, 1985. Terminations of this type include a cable connection portion at one end and a termination portion at the other end and an elongate metal rod connecting the two ends. The rod may be constructed so that the cable connection end and the termination end are disposed at a right angle. However, since bar stock is being used to make such right angle transition, a barrel portion will not be presented to accommodate the stripped end of the cable for crimping or other mechanical and electrical connection thereto. Thus, the termination described in the '430 patent requires the use of a complex connection device attachable to one end of the bar stock for connecting the electrical cable thereto. Further, bar stock is more costly due in part to its additional weight and its difficulty to manufacture.

It is desirable to provide a method of using stock tubing to form an electrical connector which will make the angular transition desirable.

SUMMARY OF THE INVENTION

It is therefore an object of the present invention to provide an method of making an electrical terminal from a length of stock tubing.

It is a further object of the present invention to provide a method of making an angular transition electrical terminal from such tubing.

It is still a further object of the present invention to provide an electrical terminal of the type described above which can be easily electrically and mechanically secured to a stripped end of an electrical cable.

In the efficient attainment of the foregoing and other objects the invention looks toward providing a method of forming an angular transition electrical connector by providing a tubular member having first and second end extents, flattening a central extent intermediate said first and second end extents, bending the flattened central extent to dispose the end extents in an angular disposition with respect to one another and forming one of the end extents into a terminal end for electrical connection to an electrical device.

In a particular method described herein, the invention provides the steps of providing a tubular member having opposed end extents, one extent forming a barrel for connection to an electrical cable, the other being flattened to form a terminal tongue. A central extent of the tube is flattened and bent thereat to dispose the end extents in an angular disposition. In a particular embodiment of the present invention, the terminal tongue may again be bent to form an end at a second angular disposition with respect to the first end. Also, the terminal end may be formed into a female socket for accommodating a male projection terminal such as a post on an automobile battery or the like. A spring clip is provided which secures the opposed legs around the post in tight electrical connection.

DETAILED DESCRIPTION OF THE PREFERRED EMBODIMENTS

Figure 1:
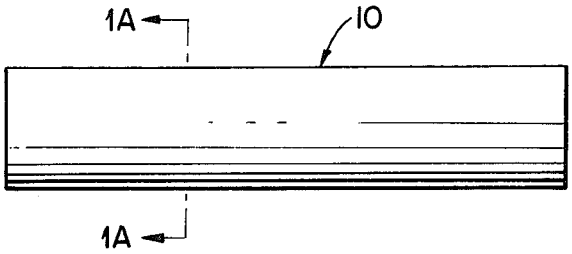
FIGS. 1 and 1*a* show respectively a side elevational view and a central vertical section of a length of stock tubular material used to form a terminal in accordance with the method of the present invention.
Figure 1A:
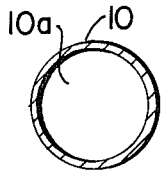

Referring to FIGS. 1 and 1A of the drawings, in order to form an electrical terminal in accordance with the method of the present invention a length of substantially cylindrical, metal tubing 10 is employed having a central bore 10*a*. Tubing 10 is cut from a longer stock length of such tubing (not shown). The diameter of the tubing is appropriately selected for the size, i.e., the wire gauge of the cable which is to be terminated. The length of the tubing is selected based on the particular application desired. As the metal tubing 10 is employed as an electrical connector, the metal selected is typically a high conductive malleable metal such as copper or aluminum.

Figure 2:
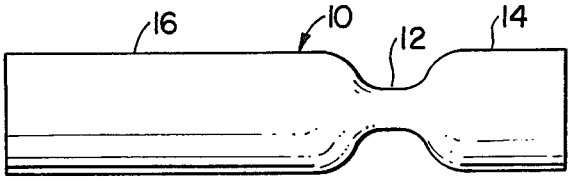
FIG. 2 shows the tube of FIG. 1 flattened along a central extent thereof.

Referring now to FIG. 2, the tubing 10 is flattened at a central extent 12 thereof. Flattening may be accomplished in a given plane by any conventional manner which causes the central section 12 to be pinched, i.e., narrowed in one direction. Central extent 12 divides the elongate tube 10 into two sections. The first end section 14 is formed into a barrel which as will be described in further detail hereinbelow, accommodates the stripped end of an electrical cable. The opposite end 16 is used to form the terminal end for exterior electrical connection.

The particular location of the flattened central extent 12 may be varied along the length of the metal tubing 10 depending on the desired connector to be formed. The central extent 12 may be formed such that there is a relatively long barrel end 14 as compared with the terminal end 16 or vice versa, a long terminal end 16 as compared with barrel end 14. However, the barrel end 14 should be of sufficient length to accommodate the stripped end of an electrical cable providing suitable mechanical and electrical connection.

Figure 3:
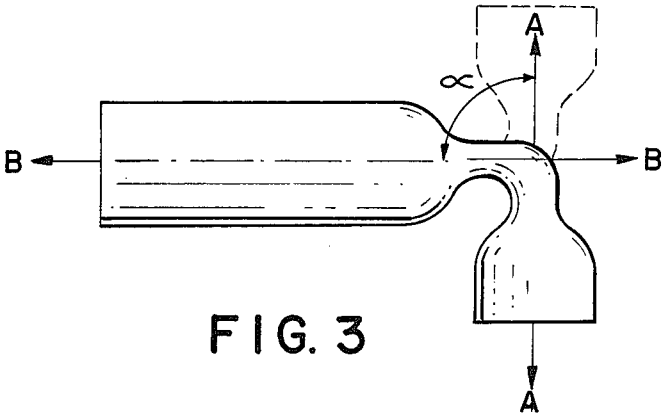
FIGS. 3 and 4 show successive steps of the method of forming an electrical terminal in accordance with the present invention.

Referring now to FIG. 3, the metal tubing 10 of FIG. 2 is bent at the flattened central extent 12 to dispose the terminal end 16 at an angular disposition with respect to barrel end 14. As referred to herein throughout, the term angular disposition means disposing the respective ends (i.e., barrel end 14 and terminal end 16) at a position where the interior angle formed therebetween is less than 180°. As shown herein throughout as the preferred embodiment the angular disposition is typically 90° thereby forming a right angle or flag-shaped connector where the longitudinal axis of the barrel end "A" is substantially normal to the longitudinal axis of the terminal end "B".

As can be seen from the comparison of FIGS. 2 and 3, the angle $\alpha$ through which the metal tube 10 is bent is from that shown in the phantom lines of FIG. 3 to that shown in the solid lines. It can be appreciated that bending will take place in the direction of the narrowed portion of central extent 12 rather than transversely thereto, thus facilitating ease of bending.

It is further contemplated that in accordance with the present invention, the tube 10 could be flattened at central extend 12 and bent thereat in a single operation.

Figure 4:
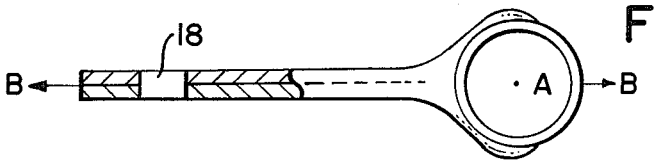

Referring now to FIG. 4, the terminal end 16 is flattened along the longitudinal axis "B" thereof causing the central bore 10*a* of tubing 10 to collapse therealong. Flattening is accomplished preferably in a plane which is tranverse to the plane in which central extent 12 is flattened. The flattened terminal end 16 will have a thickness which is substantially twice the wall thickness of metal tube 10. A connection aperture 18 may be formed in the terminal end 16 to facilitate connection of the terminal end to a connection element of an electrical device as it is conventionally known in the art, using a nut and bolt assembly or any other known fastening means.

It can be appreciated that the flattening step may be practiced after bending of the central axis 12 as decribed hereinabove, or may be accomplished prior to bending.

Figure 5:
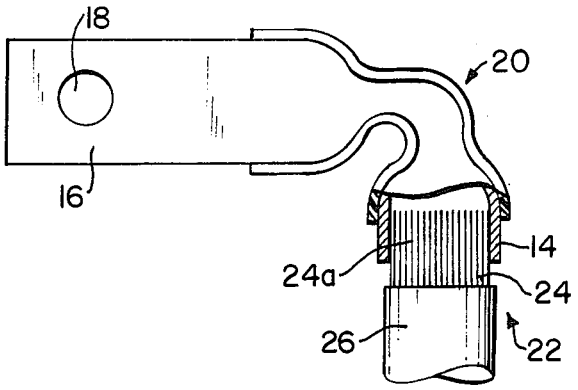
FIG. 5 shows a flag shaped electrical terminal formed in accordance with the method of the present invention including an electrical cable attached thereto and an outer insulative cover thereover.

Referring now to FIG. 5, a flag-shaped connector 20 formed in accordance with the present invention is shown. Connector 20 includes a flat terminal end 16 with mounting aperture 18 therethrough. An electrical cable 22 having stranded conductors 24 therein may be connected to the connector 20 by stripping an end extent of the insulation 26 therefrom and crimping the bared end 24*a* in the barrel 14. The connector 20 may also include an insulated covering 26 formed thereover which electrically isolates one connector from an adjacent connector. The insulative cover may be of any suitably insulative plastic which is well known in the art.

It is contemplated that plural connectors of the present invention may be used in close proximity by having terminal ends 16 of succesively increasing lengths. Thus, plural parallel electrical cables 22 may be terminated with successive connectors 20 to form a transition from vertically spaced connection points on an electrical device to the horizontally spaced cables. It is further contemplated that the barrel ends 14 may be of differing lengths to accommodate bared cable ends which are horizontally spaced and vertically aligned.

Figure 6:
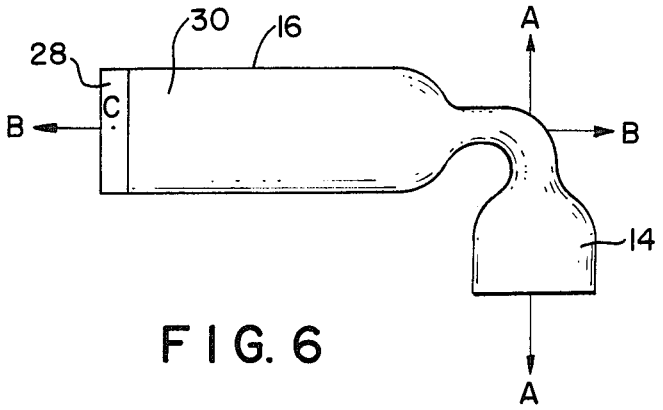
FIGS. 6 and 7 show in side elevation and top plan view respectively an alternate embodiment of an electrical terminal formed in accordance with the present invention.
Figure 7:
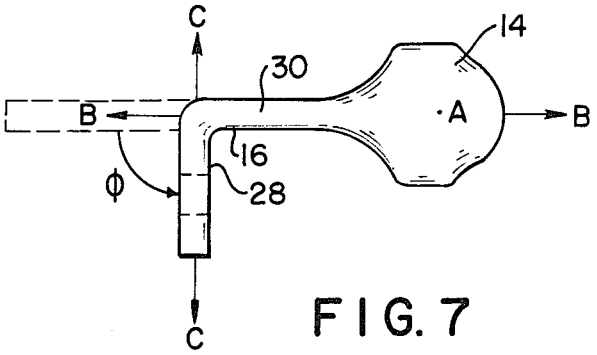
Figure 8:
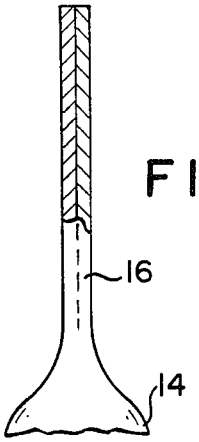
FIGS. 8 through 12 show the successive steps of the method of forming a still further embodiment of an electrical terminal in accordance with the present invention.

Referring now to FIGS. 6 and 7, an alterrate embodiment of the connector of the present invention may be described. Preceeding from FIG. 4, as above described, a second angular bend may be placed in the terminal ends 16 to place a distal end extent 28 at an angular disposition with respect to the remaining portion 30. Again, in the preferred embodiment distal extent 28 is bent into a 90° orientation wherein longitudinal axis "B" is substantially normal to longitudinal axis "C" as shown in FIG. 7. It is also preferred that the bending take place in a plane which will dispose the longitudinal axis of distal extent 28 not only substantially transverse to longitudinal axis "B", but also substantially transverse to the longitudinal axis "A" of barrel portion 14.

As mentioned above, it is contemplated that the distal extent 28 and the remaining extent 30 may be of differing lengths so as to accommodate unique orientations of cables with respect to the connection elements of the devices to which they are connected. In fact, a combination of connectors shown in FIGS. 5 and 7 may be employed in one installation to make desired connections.

Referring now to FIGS. 8 through 14, a further embodiment of the present invention may be described. In addition to forming a flattened terminal end 16 a bifurcated female socket type terminal end may be formed. Preceeding from the step shown in FIG. 4, the flattened terminal end 16 is again shown in FIG. 8 prior to aperture 18 being placed therethrough.

Figure 9:
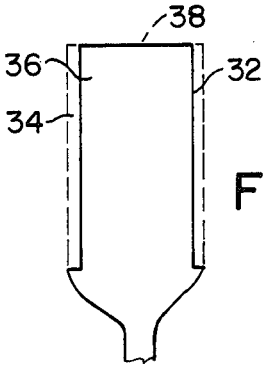

Referring to FIG. 9, elongate unitary portions 32 and 34 on opposite sides of flattened, terminal end 16 are trimmed or cut therefrom and are removed as scrap. The unitary portions 32 and 34 are trimmed down to the central bore 10*a* leaving a pair of cantilevered extending legs 36 and 38.

Figure 10:
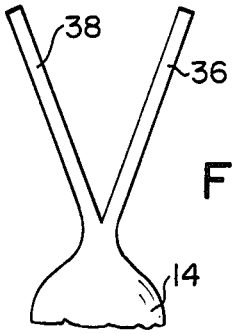
Figure 11:
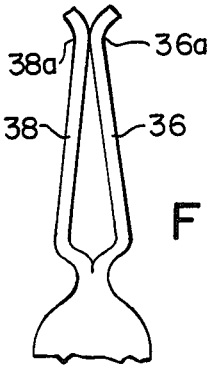

Referring to FIG. 10, the flat elongate legs 36 and 38 are then separated at the end opposite barrel portion 14. A forming die (not shown) may be brought down between the two flattened legs 36 and 38 to spread them apart. The same or another forming die may be employed to compress the legs into a desired shape such as that shown in FIG. 11. In the particular design shown in FIG. 11, the legs include contact portions 36*a* and 38*a* which provide for connection to the terminal post of a battery or similar device (FIG. 13).

Figure 12:
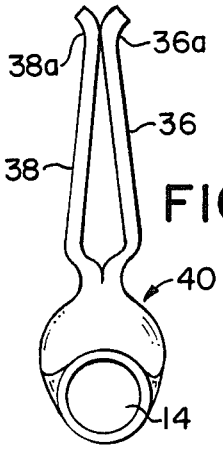

The connector 40 formed in the manner as above-described is shown in FIG. 12.

Figure 13:
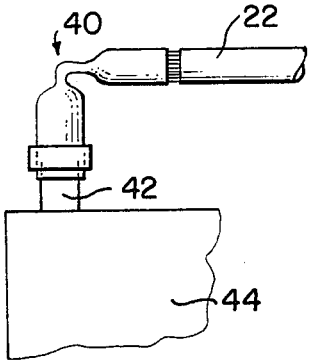
FIG. 13 shows the electrical terminal connector of FIG. 12 attached to a battery post.
Figure 14:
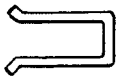
FIG. 14 shows in top plan view the retaining clip used to secure the electrical terminal of FIG. 13 to the battery post.

Connector 40 is further shown in FIG. 13 including electrical cable 22 crimped thereto and connected to a terminal post 42 of a battery 44. As the terminal legs 36 and 38 are formed of a readily malleable material, such as aluminum or copper, a non-resilient clip, such as that shown in FIG. 14 may be employed to hold the legs together around the battery post 42. Clip 14 is a substantially U-shaped member formed of a rigid material such as steel which when placed around the terminal legs 36 and 38 will prevent the outward spreading thereof.

Various changes to the foregoing described and shown structures would now be evident to those skilled in the art. Accordingly, the particularly disclosed scope of the invention is set forth in the following claims.

We claim:

1. A method of forming an angular transition electrical cable connector from an elongate tubular member comprising the steps of:

providing said tubular member having first and second opposed elongate end extents, one end extent forming a barrel for accommodating an electrical cable end;

flattening a central extent of said tubular member intermediate said first and second end without substantially flattening the end extents;

bending said tubular member at said flattened central extent to dispose said first end extent at an angular disposition with respect to said second end extent; and forming the second end extent into a terminal end for electrical connection to an electrical device.

2. A method in accordance with claim 1 wherein said angular disposition of said end extents is substantially 90°.

3. A method in accordance with claim 2 wherein said forming step includes:

flattening said second end extent to form a terminal tongue.

4. A method in accordance with claim 3 wherein said second end extent is flattened in a plane transverse to the plane in which said central extent is flattened.

5. A method in accordance with claim 4 wherein said forming step further includes placing an aperture through said terminal tongue to accommodate a fastening element therethrough.

6. A method in accordance with claim 4 further including the step of separating the flattened end extent forming said terminal tongue into a pair of outwardly spaced terminal legs which mutually define a female socket.

7. A method in accordance with claim 6 wherein said terminal legs are spring biased to frictionally accommodate a male terminal member therebetween.

8. A method in accordance with claim 7 further including the step of placing a retaining ring around said spaced terminal legs to limit the movement of said legs in the outward direction.

9. A method in accordance with claim 3 wherein said barrel accommodates a stripped end of said electrical cable.

10. A method in accordance with claim 3 wherein said step of flattening said second end extent is practiced prior to said step of bending said tubular member.

11. A method in accordance with claim 3 wherein said flattened end extent is elongate.

12. A method in accordance with claim 11 further including bending said elongate flattened end extent at a location intermediate thereof to dispose portions of said flattened end extent at substantially a right angle.

13. A method in acordance with claim 12 wherein each of said portions of said bent end extent are elongate each having a longitudinal axis which is disposed tranversely to the longitudinal axis of said one end extent.

14. A method of forming a flag-shaped electrical terminal comprising the steps of:

providing a length of hollow tubular material having a first end extent a second end extent and a central extent;

flattening a portion of said central extent intermediate said first and second end extents without substantially flattening the end extents;

bending said length of tubular material at said central extent to dispose said first and second end extents at a substantially right angle; and forming an interconnection end from one of said end extents.

15. A method in accordance with claim 14 wherein said forming step includes flattening said one end extent into a terminal tongue.

16. A method in accordance with claim 14 wherein said forming step includes:

forming said one end extent into a pair of connection legs.

17. A method in accordance with claim 14 wherein the other end extent accommodates a stripped end of an electrical cable.

* * * * *